United States Patent [19]

Walsh

[11] 4,342,656

[45] Aug. 3, 1982

[54] PROCESS FOR DISPOSAL OF AQUEOUS LIPOIDAL WASTES

[75] Inventor: Thomas J. Walsh, Pepper Pike, Ohio

[73] Assignee: SCM Corporation, New York, N.Y.

[21] Appl. No.: 271,012

[22] Filed: Jun. 5, 1981

Related U.S. Application Data

[63] Continuation-in-part of Ser. No. 903,485, May 8, 1978, abandoned.

[51] Int. Cl.[3] ..... F23G 7/00

[52] U.S. Cl. ..... 210/770; 210/776; 431/2

[58] Field of Search ..... 210/776, 600, 774, 770; 431/2, 11; 260/412.5; 44/66

[56] References Cited

U.S. PATENT DOCUMENTS

| | | | |
|---|---|---|---|
| 3,667,152 | 6/1972 | Eckert | 44/66 |
| 3,749,318 | 7/1973 | Cottell | 431/2 |
| 3,876,363 | 4/1975 | La Haye et al. | 431/11 |
| 3,958,915 | 5/1976 | Noda et al. | 431/2 |
| 3,961,915 | 6/1976 | Wisotsky | 44/66 |
| 4,170,551 | 10/1979 | Honour | 431/2 |

OTHER PUBLICATIONS

Gaulin Pamphlet, "Water-In-Fuel Oil Homogenizers".

*Primary Examiner*—Benoît Castel
*Attorney, Agent, or Firm*—Richard H. Thomas

[57] ABSTRACT

Normally non-combustible lipoidal waste which has been separated from a waste water stream is disposed of and its fuel value recovered by mixing the waste with fuel oil and burning the mixture.

3 Claims, No Drawings

PROCESS FOR DISPOSAL OF AQUEOUS LIPOIDAL WASTES

This is a continuation-in-part of application Ser. No. 903,485, filed May 8, 1978 now abandoned.

This invention relates to waste disposal, and more particularly to disposal of lipoidal wastes.

BACKGROUND OF THE INVENTION

Such wastes are generated in the refining of fats and vegetable oils, in fat rendering, in tall oil recovery and refining, etc. Typical sources of such wastes include alkali refining, saponification, acidulation, tank and tank wagon cleanings, and accidental spills.

Usually such wastes are collected by skimming off a waste water tank. Frequently more sophisticated methods are used to achieve an even greater recovery in separation, for example, recovery in the manner of the Joseph and Kiegher waste water treatment process, U.S. Pat. No. 4,001,114.

In the absence of concentration of the oil skimming, such skimming contains about 50 percent by weight water. Its value as a commodity is about two cents ($0.02) per pound or approximately thirty-two cents ($0.32) per gallon of oil content. However, the oil portion of the skimming has considerable fuel value; for example, coconut oil has a heat of combustion of about 16,236 BTU/lb. and other oils such as rapeseed oil reach as high as about 17,424 BTU/lb. This fuel value cannot be readily recovered because of the relatively large amount of water associated with the waste prevents it from being utilized directly as a fuel.

To take advantage of the fuel value of the lipoidal waste, it is preferably necessary to reduce its water content substantially so that the waste water will not prevent its satisfactory combustion. The processes known in the art for separating the water fraction from lipoidal waste are tedious, complicated, and often quite unsatisfactory.

Applicant has discovered a process which allows the recovery of the fuel value of a lipoidal waste which is merely separated by skimming or other economical means from the waste water of a lipid processing operation. The present process not only disposes of the lipid; it eliminates the need for further processing and recovers the fuel value of the lipid fraction of the waste. The fuel value of the lipid is slightly less than the fuel value of petroleum; however, it is substantially more than the value of the waste as a commodity for other uses.

SUMMARY OF THE INVENTION

The present invention is a process for disposal of lipoidal waste which has been separated from the waste water of a lipid processing operation which comprises; dispersing said waste in fuel oil in a state of subdivision adequate for it remaining substantially completely dispersed until combustion of said oil, said dispersion being combustible.

DETAILED DESCRIPTION OF THE INVENTION

The lipoidal waste useful in the present invention is produced by any of several lipid processing operations. The waste water from such operation will contain lipoidal wastes which typically do not mix well with the waste water and when the waste water is allowed to stand such as in a tank or pond, the lipoidal wastes tend to float on the waste water. It is thus a relatively simple matter to skim or strain or otherwise separate the lipoidal wastes from the surface of the waste water collection.

A typical lipoidal waste separated from such waste water will contain about 50% by weight waste lipids, although, being a waste, the lipid content can vary widely, e.g., from about 30% to about 70% or even more. The remainder of the waste is predominantly water with other residuals and other contaminants. The water content of the waste, however, is not readily separated from the lipoidal fraction of the waste because it is typically in the form of a very complex emulsion and because of its complex nature is not easily broken to facilitate further separation of the lipoidal waste from the water fraction associated with it. Salting out solids and centrifugal separation are possible, but are expensive and not wholly satisfactory. The lipoidal composition of such waste ordinarily includes unsaponifiable material, usually called "unsaps", saponifiable material such as esters, acids such as fatty acids, and soaps of such acids. "Unsaps" usually include some hydrocarbon material, alcohols such as sterols, and often phospholipids.

According to the present invention, the lipoidal waste is dispersed in fuel oil. The equipment useful for performing the instant dispersing includes homogenizers, typically those operating between 1000 and 5000 psi, colloidal mills, homogenizing valve assemblies, mixers, and the like. Homogenizing equipment is available which is designed for the purpose of homogenizing a small fraction of water in fuel oil. Such equipment can be readily adapted to the instant service. Lipoidal waste, however, because of the surface tension lowering materials indigenous to it is easier to disperse in fuel oil than is common water. Therefore, the severe conditions required to effectively homogenize water in fuel oil will not be required to disperse lipoidal wastes and therefore less complicated and less expensive equipment can be utilized for the instant service. Simple mixing of some lipoidal wastes has been shown effective and after mixing no subsequent tendency to reseparate was noticed.

A typical installation for the instant purpose includes a steam heated fuel oil delivery line (oil under pressure) in which is injected a metered quantity of pumped lipoidal waste. This mixture then is delivered to a homogenizer which discharges through a homogenizing valve, hence to a combustion apparatus such as a boiler. The excess of dispersion accepted by the boiler is returned by recycle line through an intake line of the homogenizer, typically with a check valve to prevent backflow in such recycle line toward the combustion apparatus. Those parts of the apparatus susceptible to corrosion generally are made of austenitic stainless steel or other corrosion resistant alloy. Harder alloys are used for special wear resistance. For economy the rest of the apparatus usually is made of mild steel.

The quantity of lipoidal waste dispersed in the fuel oil is determined primarily by the water content of said waste. When common water is dispersed in fuel oil, it is preferred to disperse from about 5 to about 10 percent of said water in said fuel oil. However, some proposals call for as much as about 25% by weight water and others as low as 2–3%. Mixing lipoidal waste with fuel oil to achieve similar water contents is preferred.

The invention can be better understood by reference to the following example which sets forth a basis of design for a fuel oil/aqueous lipoidal waste dispersing apparatus having capacity of about 560 gallons per hour of fuel oil. The example should not be construed as limiting invention. In this application all temperatures are in degrees Centigrade, all percentages are weight percentages, and all parts are parts by weight unless otherwise expressly indicated.

EXAMPLE

A flow of aqueous lipoidal waste containing about 50% lipids, said waste being skimmings from a skimming pond at a vegetable oil refinery, is injected at the rate of 500 lbs. per hour into a flow of No. 6 fuel oil, the oil flowing at about 4100 lbs. per hour. The fuel oil (0.7% sulfur) is at 200° F. (93° C.) and 160 psig. The aqueous waste is finely dispersed in the fuel oil by passing the mixture of waste and oil through a Model FE3-2.5TPS Gaulin high shear fuel emulsion homogenizer, then a homogenizing valve, this homogenizing being at about 2000 psig. The thus-emulsified mixture using no added emulsifier is fed to the combustor of a boiler with excess output from the homogenizer being recycled to its intake. The waste is sufficiently finely dispersed in the oil to say in suspension for a long time period, thus being a substantially stable dispersion for effective combustion.

I claim:

1. A process for recovering the fuel value of a normally unburnable lipoidal waste and disposing of said waste wherein said lipoidal waste comprises waste lipids and water, and is the waste product of a process selected from the group consisting of: refining of fats, refining of oils, fat rendering, tall oil recovery, tall oil refining, alkali refining of lipids and saponification of lipids, comprising the steps of:

(a) separating said lipoidal waste from a portion of the waste water to produce a concentrated lipoidal waste which is about 30–70% waste lipids, the remainder being predominantly waste water in a complex emulsion from with the waste lipids;

(b) mixing said concentrated lipoidal waste with fuel oil to form a combustible mixture; and (c) burning said mixture;

said lipoidal waste containing indigenous surface tension lowering materials selected from the group consisting of saponifiable materials, unsaponifiable materials, acids, and soaps which facilitate said mixing, said mixing producing a state of subdivision effective for substantially complete dispersion of the lipoidal waste in the fuel oil until combustion.

2. The process of claim 1 wherein said lipoidal waste is separated from said waste water by skimming.

3. The process of claim 1 wherein said mixing is carried out by simple mixing.

* * * * *